US006315857B1

(12) United States Patent
Cheng et al.

(10) Patent No.: US 6,315,857 B1
(45) Date of Patent: Nov. 13, 2001

(54) POLISHING PAD SHAPING AND PATTERNING

(75) Inventors: Tsungnan Cheng, Saratoga; Ethan C. Wilson, Sunnyvale; Shou-sung Chang, Sunnyvale; Gregory C. Lee, Sunnyvale; Huey M. Tzeng, San Jose; David E. Weldon, Santa Clara; Linh X. Can, San Jose; Luis Lau, Santa Clara; Siyuan Yang, Cupertino, all of CA (US)

(73) Assignee: Mosel Vitelic, Inc., Hsinchu (TW)

( * ) Notice: Subject to any disclaimer, the term of this patent is extended or adjusted under 35 U.S.C. 154(b) by 0 days.

(21) Appl. No.: 09/113,714

(22) Filed: Jul. 10, 1998

(51) Int. Cl.[7] ..... B24B 21/00; B24B 29/00

(52) U.S. Cl. ..... 156/345; 451/288; 451/296; 451/168

(58) Field of Search ..... 156/345; 451/288, 451/287, 296, 168; 216/38, 88, 89; 438/691, 692

(56) References Cited

U.S. PATENT DOCUMENTS 5,197,999 3/1993 Thomas ..... 51/298
5,257,478 11/1993 Hyde et al. ..... 51/131.3
5,534,106 * 7/1996 Cote et al. ..... 156/636.1
5,575,707 * 11/1996 Talieh et al. ..... 451/173
5,584,146 * 12/1996 Shamouillan et al. ..... 51/293
5,628,862 * 5/1997 Yu et al. ..... 156/345
5,800,248 * 9/1998 Pant et al. ..... 451/41
5,810,964 * 9/1998 Shiraishi ..... 156/345

* cited by examiner

*Primary Examiner*—Gregory Mills
*Assistant Examiner*—Sylvia R. MacArthur
(74) *Attorney, Agent, or Firm*—Skjerven Morrill MacPherson LLP

(57) ABSTRACT

Polishing pads are provided for a linear chemical mechanical polishing apparatus used in manufacturing integrated circuits. The polishing pads, which are attached to a polishing belt, are grooved in patterns to advantageously transport slurry from the point of introduction to the point at which semiconductor wafers are polished. The patterns include at least one set of multiple parallel grooves extending across the polishing pads. The grooves form an angle with the direction of travel of the belt that is unequal to zero.

9 Claims, 4 Drawing Sheets

POLISHING PAD SHAPING AND PATTERNING

BACKGROUND

1. Field of the Invention

The present invention relates generally to polishing tools, and more particularly to polishing pads for belt-type semiconductor wafer polishing tools.

2. Description of Related Art

Chemical mechanical polishing (CMP) in semiconductor processing removes the highest points from the surface of a wafer to polish the surface. CMP operations are performed on unprocessed and partially processed wafers. A typical unprocessed wafer is crystalline silicon or another semiconductor material that is formed into a nearly circular wafer. When ready for polishing, a typical processed or partially processed wafer has a top layer of a dielectric material such as glass, silicon dioxide, or of a metal, over one or more patterned layers that create local topological features on the order of about 1 $\mu$m in height on the wafer's surface. Ideally, polishing smoothes the local features so that the surface of the wafer is flat or planarized over an area the size of a die formed on the wafer. Currently, polishing is sought that locally planarizes the wafer to a tolerance of about 0.3 $\mu$m over the area of a die about 10 mm by 10 mm in size.

A conventional belt polisher includes a belt carrying one or more polishing pads, a wafer carrier head which holds a wafer, and a support assembly that supports the portion of the belt under the wafer. For CMP, the polishing pads are sprayed with a slurry, and pulleys drive the belt. The carrier head brings the wafer into contact with the polishing pads so that the polishing pads slide against the surface of the wafer. Chemical action of the slurry and the mechanical action of the polishing pads and abrasives in the slurry against the surface of the wafer remove material from the wafer's surface.

Traditionally, CMP is performed using a planetary CMP apparatus. A planetary polishing apparatus typically includes a rotating polishing table on which polishing pads are mounted. A silicon wafer, held and rotated by a polishing head, is pressed against the surface of the polishing pads in complex motion. Slurry is sprayed or applied onto the surface of the polishing pads by a slurry dispenser. Due to the centrifugal force of the rotating polishing table, the distribution of slurry under the wafer is not entirely uniform, the density of slurry becoming lower toward the periphery of the rotating polishing table.

Recently, linear wafer polishing machines that advantageously address processing requirements of the semiconductor industry have been disclosed. For example, a linear polisher is described in U.S. patent application Ser. No. 08/964,930, entitled "Modular Wafer Polishing Apparatus and Method." In this machine, wafers, held vertically by a wafer carrier head, are pressed against polishing pads attached to a continuous polishing belt. A slurry dispenser is positioned upstream relative to the direction of travel of the polishing belt, as described, for example, in U.S. patent application Ser. No. 08/965,067, entitled "Apparatus for Dispensing Slurry." The slurry needs to be transported on the polishing pads from the point at which it is applied by the dispenser to the point at which the wafer contacts the polishing pads.

Slurry transport is frequently accomplished by providing some non-uniformity in the surface of the polishing pad, such as perforations or grooves in which slurry tends to accumulate. However, any non-uniformity in the polishing pad surface is a potential polishing defect, that is, any location at which the pad does not touch the wafer results in a region of lower removal rate and potential non-uniform polishing. What is a needed is a method of slurry transport in a belt polishing machine that ensures process uniformity.

In addition, in a vertically oriented belt polishing apparatus, such as that described in Ser. No. 08/965,067, wafers may be polished simultaneously on each side of the polishing belt. Thus, on one side of the machine, the polishing belt is moving upward past the wafer and on the other side, the belt is moving downward. It would be desirable to provide a method of slurry transport that overcomes the effect of gravity in a vertically oriented belt polishing machine to ensure an even distribution of slurry on the polishing pads.

SUMMARY

In accordance with the present invention, polishing pads attached to a polishing belt in a linear polishing machine are patterned to provide slurry transport, thus ensuring an even distribution of slurry.

The polishing belt in a linear polishing machine can be a continuous loop belt. Alternatively, the polishing belt can be an open loop belt. Belt polishing is performed with the belt oriented horizontally or vertically. The direction of travel of a vertically oriented belt can be horizontal or vertical. One or more polishing pads are attached to the polishing belt. Alternatively, the polishing pad is molded to the polishing belt such that it takes the same form, continuous loop or open loop, as the polishing belt.

In one embodiment of the present invention, multiple grooves extend horizontally across polishing pads, perpendicular to the direction of travel of the belt. Slurry tends to flow in the grooves, and is thus transported from the location along the polishing belt at which it is dispensed to the position at which the wafer is polished. In one embodiment, multiple grooves extend diagonally across the pads. Another embodiment has grooves extending diagonally in both directions, resulting in a cross-hatched or diamond pattern. Finally, the invention also includes a polishing pad grooving pattern that combines the diamond pattern and horizontal grooves. The grooves of the present invention may be in the form of straight lines or they may take different, generally linear forms, such as zig-zag lines, or wavy or sinusoidal lines. When the grooves take the form of zig-zag, or wavy or sinusoidal lines, they may alternatively be oriented vertically, that is generally perpendicular to the direction of travel of the belt.

According to another aspect of the present invention, a mosaic pad, that is a polishing pad with more than one grooving pattern, is provided. The mosaic pad is divided into three portions, with one grooving pattern on the outside portions of the pad and a different pattern on the middle portion. In one embodiment the seam between the portions is slanted with respect to the outer edge of the pad.

The polishing pads of the present invention are in the shape of a parallelogram. The polishing pads may be rectangular in shape. In one embodiment, the polishing pads are in the shape of a parallelogram with the long sides parallel to the direction of travel of the polishing belt and the short sides slanted with respect to the direction of travel. The slanted pad ends advantageously affect adhesion of the polishing pads to the polishing belt as the pad ends travel over the pulleys which drive the belt.

The present invention is better understood upon consideration of the detailed description below in conjunction with the accompanying drawings.

DETAILED DESCRIPTION OF THE PREFERRED EMBODIMENTS

Figure 1B:
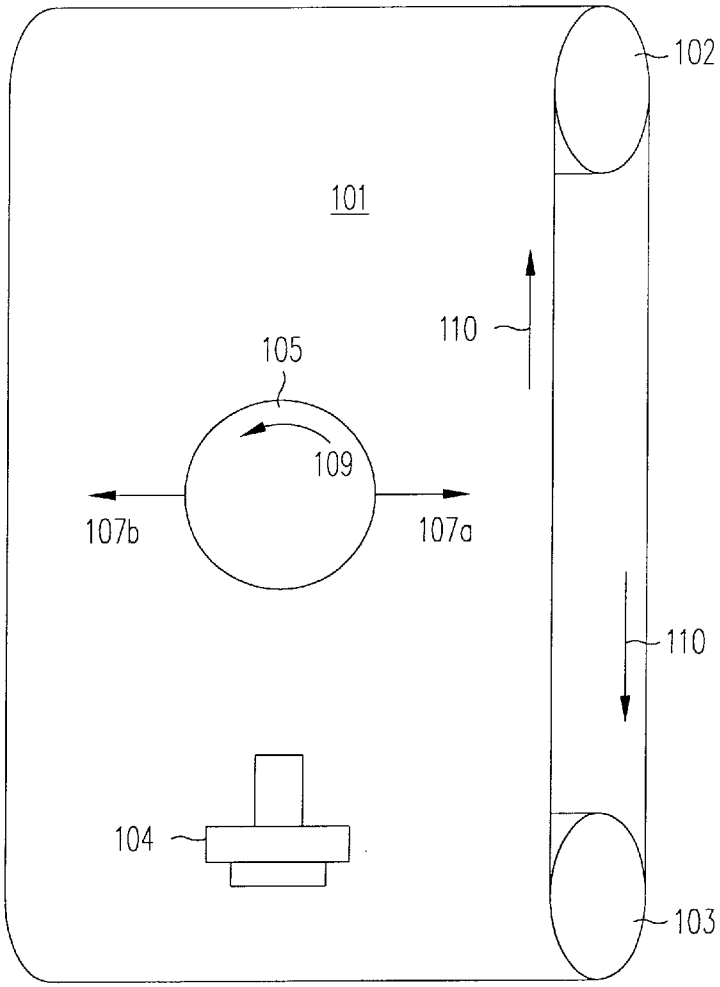
FIGS. 1*a* and 1*b* show, respectively, front and side views of a CMP apparatus 100.

The present invention provides grooving patterns for polishing pads in a CMP apparatus. The grooving patterns uniformly distribute the non-uniformity in the surface of the polishing pads and advantageously promote slurry transport thus ensuring an even distribution of slurry. To simplify the detailed description below, like elements in the figures are provided like reference numerals.

Figure 1A:
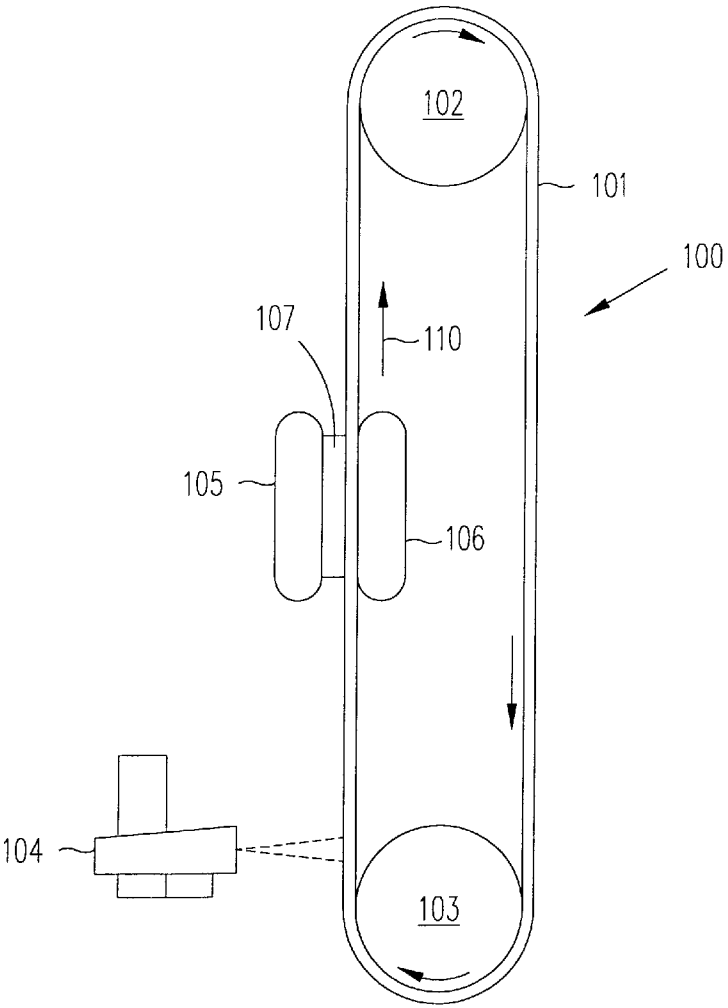

FIGS. 1*a* and 1*b* show vertically oriented CMP apparatus 100 in side and front views, respectively. As shown in FIGS. 1*a* and 1*b,* CMP apparatus 100 includes a continuous polishing belt 101 configured to polish one or more vertically held semiconductor wafers, such as wafer 107. Wafer 107 is held vertically by a polishing head 105, which presses wafer 107 against a polishing pad 201, shown in FIG. 2, attached to a vertically mounted polishing belt 101. Polishing belt 101 is kept in continuous motion by rotating pulleys 102 and 103. A support assembly 106 provides a backward pressure to hold wafer 107 against polishing belt 101. Polishing head 105 rotates in a predetermined direction indicated by reference numeral 109 and is optionally moved back and forth across the polishing pad surface in straight lines indicated by reference numerals 107*a* and 107*b*.

Figure 2:
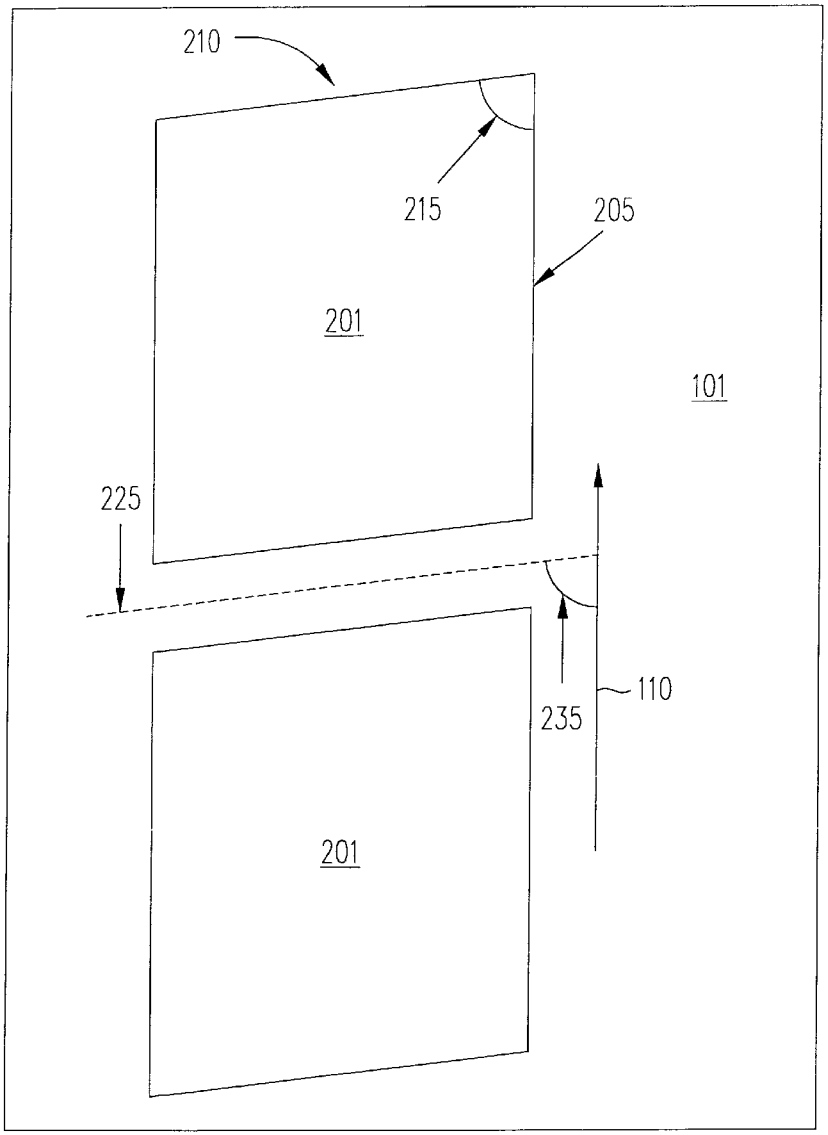
FIG. 2 shows a polishing belt with attached polishing pads.

As shown in FIG. 2, multiple polishing pads 201 are attached to polishing belt 101. The direction of travel of polishing belt 101, which is typically constructed of stainless steel, is indicated by reference numeral 110 in FIGS. 1*a,* 1*b,* and 2. The long sides 205 of polishing pads 201 are parallel to the direction of travel 110. A slurry dispenser 104 is positioned a short distance upstream from polishing head 105, relative to direction 110 . Slurry dispenser 104 sprays a controlled stream of slurry onto polishing pads 201.

Figure 3A:
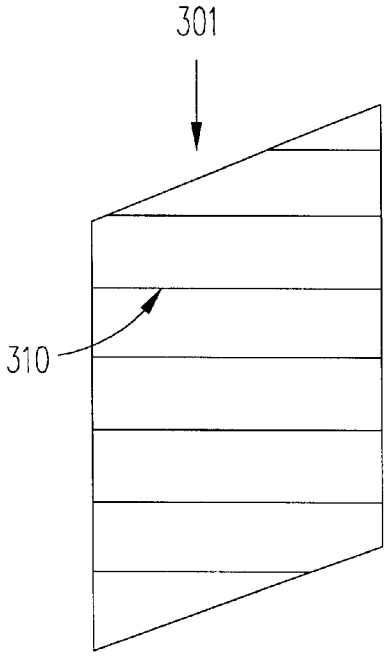
FIGS. 3*a*–3*d* show polishing pads with grooving patterns according to the present invention.
Figure 3B:
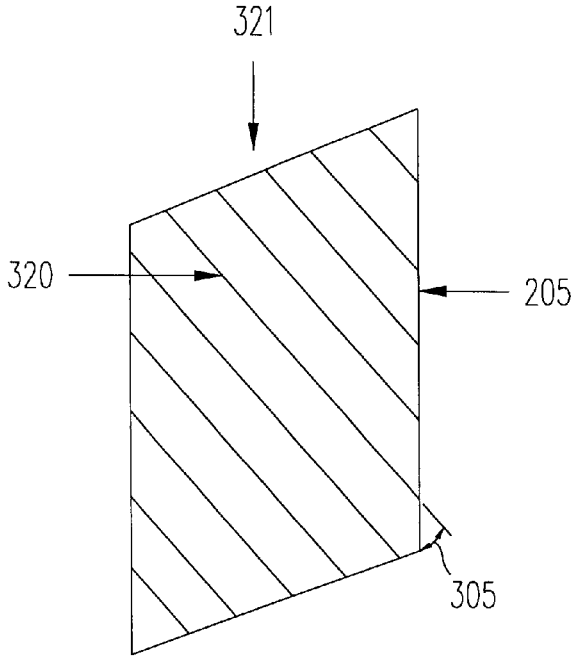

The present invention provides grooving patterns for the polishing pads, 201 that ensures slurry transport on the pads from the point at which the slurry is applied by slurry dispenser 104 to the point at which wafer 107 contacts the pad. As shown in FIG. 3*a,* in one embodiment, multiple substantially parallel grooves 310 extend horizontally across the top surface of pad 301, perpendicular to the direction of travel 110 of the belt. Another embodiment, pad 321, with groove pattern 320 is illustrated in FIG. 3*b.* In this case, the grooves 320 extend diagonally across the pad, that is grooves 320 make an angle 305 with respect to the pad side 205, that is less than 90 degrees and preferably between 30 and 60 degrees. Note that when the polishing pad 201 is attached to polishing belt 101, the pad side 205 is parallel to the direction of travel 110. Thus, the angle between the grooves 320 and the direction of travel 110 is also defined by angle 305. Alternatively, grooves 320 extend diagonally across the pad in the opposite direction. That is the angle 305 of grooves 320 with respect to pad side 205 is between 90 and 180 degrees and preferably between 120 and 150 degrees.

Figure 3C:
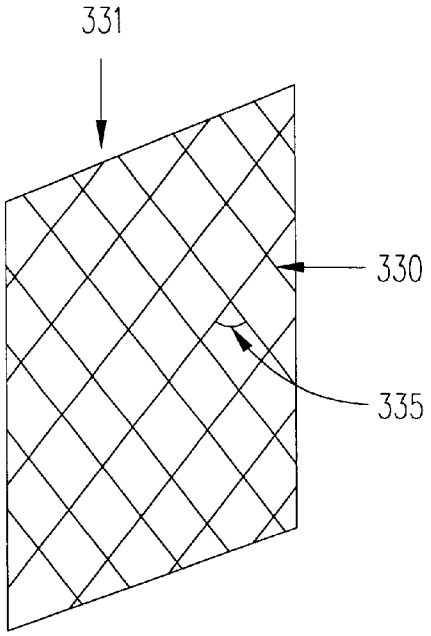
Figure 3D:
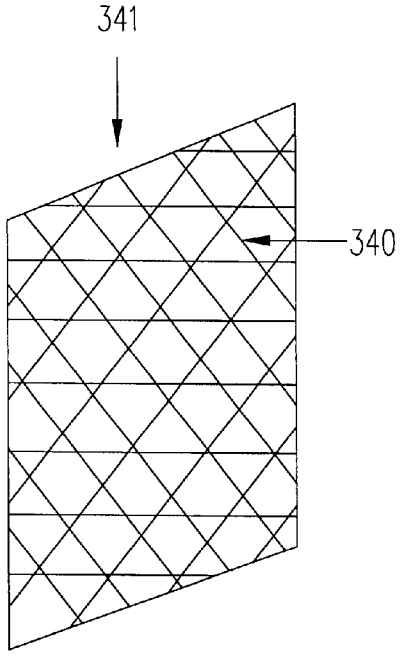

FIG. 3*c* shows another embodiment, pad 331, in which diagonal grooves 330 extend across polishing pad 201 in both directions resulting in a cross-hatched or diamond pattern. Angle 335 between the grooves extending from the upper left to lower right and those extending from the upper right to lower left, in FIG. 3*c,* is between 10 and 170 degrees, and preferably between 60 and 120 degrees. Alternatively, groove patterns 310 and 330 may be combined to produce groove pattern 340, on pad 341, illustrated in FIG. 3*d.*

The grooves in groove patterns 310, 320, 330, and 340 are typically substantially rectangular in cross section and between 0.01 and 0.1 inches in depth and between 0.01 and 0.2 inches in width. Alternatively, the grooves have a v-shaped cross section, coming to a sharp point at the bottom of the groove, or a u-shaped cross section with a rounded bottom. Typical spacing between grooves is from 0.1 to 5 inches.

Figure 4A:
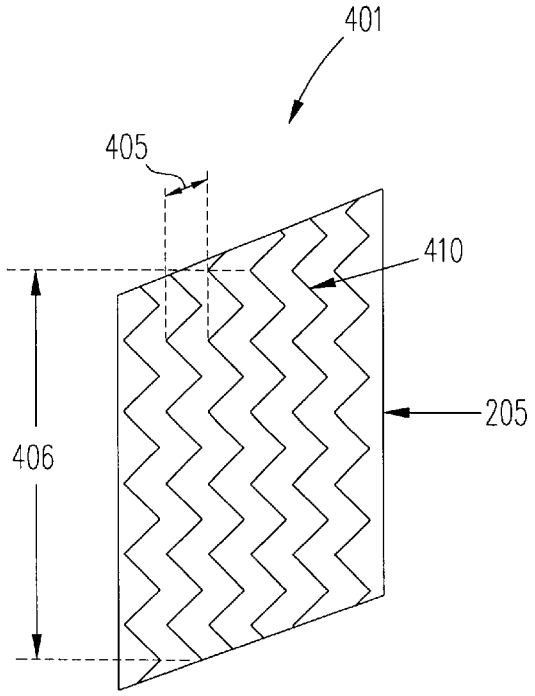
FIGS. 4*a* and 4*b* show polishing pads with zig-zag grooves and wavy grooves, respectively, according to the present invention.
Figure 4B:
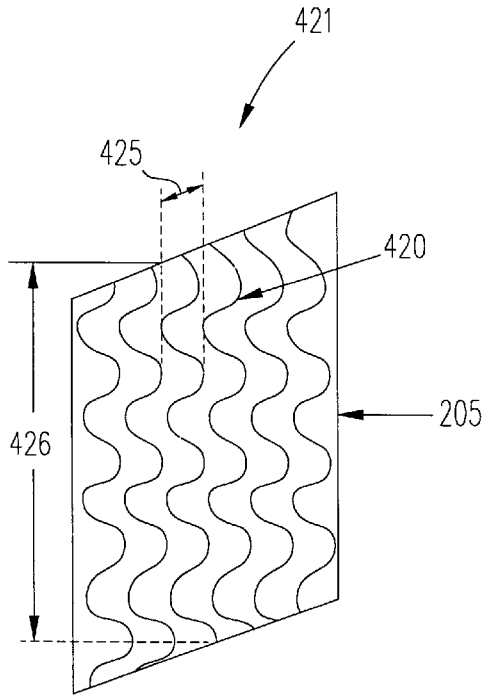

Although straight line grooves are depicted in FIG. 3, the grooves alternatively, can take any continuous, generally linearly form. For example, the grooves can be zig-zag or saw-tooth lines, as shown in FIG. 4*a,* or wavy or sinusoidal lines, as illustrated in FIG. 4*b.* The generally linear groove forms of the present invention are characterized by having an extent in one direction, denoted by 406 and 426 in FIGS. 4*a* and 4*b,* respectively, that is much greater than their extent in a second perpendicular direction, denoted by 405 and 425. The zig-zag or wavy grooves can be oriented such that the long direction extends across the polishing pads horizontally or diagonally, as illustrated for linear grooves in FIG. 3. Alternatively, as shown in FIGS. 4*a* and 4*b,* zig-zag or wavy grooves are oriented vertically, with the long direction parallel to the pad side 205.

Polishing pads 201 are typically made of a polyurethane material. For example, polishing pads 201 are made of the material denoted IC1000, available from Rodel, Inc. of Newark, Del. Alternatively, stacked polishing pads, which have two layers bonded together, a top layer of a stiffer polyurethane material and a bottom layer of a softer material, are used. For example, the pad denoted IC1400 from Rodel, Inc. is used. The grooving patterns of the present invention are advantageously used on the top layer of stacked polishing pads.

While FIG. 1 shows only one side of the vertical polishing belt assembly being used for wafer polishing, polishing heads and accompanying mechanisms can be provided on both sides of the polishing belt assembly of CMP apparatus 100 to increase the total wafer throughput. On the side of the apparatus on which the belt is moving upward, for example, on the left side of the belt as shown in FIG. 1*a,* slurry dispenser 104 is positioned below the wafer. The grooving patterns of the present invention have the additional benefit of overcoming the effects of gravity in a vertically oriented polishing apparatus, providing for uniform slurry transport on both sides of the polishing belt.

Figure 5:
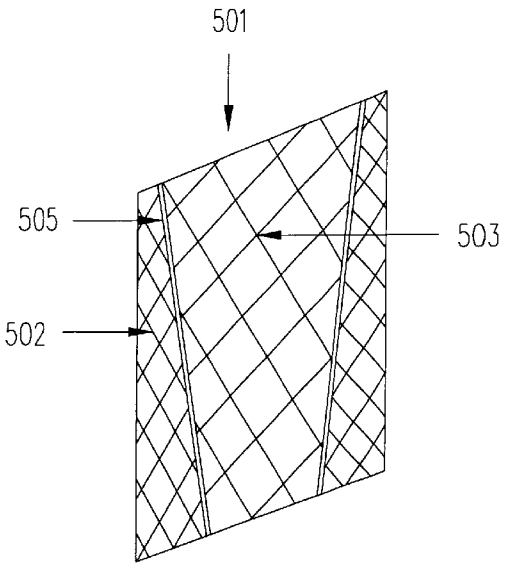
FIG. 5 shows a polishing pad grooved in a mosaic pattern according to the present invention.

According to another aspect of the present invention, a mosaic pad, that is a polishing pad with more than one pattern of surface features, is provided. The mosaic pad is divided into three portions, with one pattern on the outside portions of the pad and a different pattern on the middle portion. In one embodiment, 501, as shown in FIG. 5, the outside portions have a diamond pattern 502 with a certain spacing and the middle portion has a diamond pattern 503 with a wider spacing. This combination pattern advantageously overcomes any tendency to non-uniformly polish the wafer between the center and edge of the wafer. That is, the outer portion of the pad, with the higher density of grooves, provides a different removal rate than the inner portion. In part of its rotation, the outer edge of the wafer presses against the outer portion of the mosaic pad which has the different removal rate while the center of the wafer sees only the middle portion.

In a linear CMP apparatus such as apparatus 100, wafer 107 is held in wafer carrier head 105 by a retaining ring that contacts the polishing surface along with the wafer. A retaining ring for linear belt polishing is described, for example, in U.S. patent application Ser. No. 09/116,311, entitled "Retaining Ring for Wafer Polishing,". The mosaic pad shown in FIG. 5 is beneficially used to control polishing of the retaining ring.

In another embodiment, the patterns of the mosaic pad are reversed with a wider spacing on the outside portions and a narrower spacing on the inside portions. In one embodiment the seam 505 between the portions is slanted with respect to pad edge 205. The slanted joint between the two portions of the mosaic pad advantageously prevents differential polishing across the wafer due to the joint region of the pad. The patterned polishing pads of the present invention beneficially provide uniform polishing in a CMP belt polishing apparatus capable of user-specified lateral displacement of the polishing belt. The use of patterned pads in such a machine is described in the related application, U.S. patent application Ser. No. 09/114,485, entitled "A Robust Belt Tracking System for Hostile Environment,".

Figure 6:
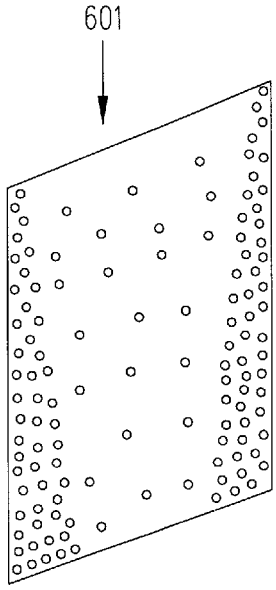
FIG. 6 shows a polishing pad with perforations forming a mosaic pattern, according to the present invention.

The mosaic polishing pad, as shown in FIG. 5 is patterned with a diamond grooving pattern. To control the rate of polishing, alternatively discontinuous feature patterns could be used in the place of grooves. For example, as illustrated by pad 601 in FIG. 6, a pattern of perforations could be used to control the polishing removal rate with the density of perforations varied to control removal rate.

Additional properties of the portions of a mosaic pad could alternatively be varied to control polishing performance. Among relevant properties are surface hardness (durometer), overall pad thickness, primary pad thickness and secondary pad thickness (stacked pad), porosity, filler type, underlying polishing belt thickness, belt contour (e.g. concave/convex), and chemical reactivity. Varying these properties selectively within a single pad is another alternative for controlling polishing.

The polishing pads of the present invention have the shape of a parallelogram. Referring to FIG. 2, the long sides 205 of polishing pads 201 are parallel to the direction of travel 110 of the polishing belt and the short sides 210 form an angle 215 with respect to the long sides 205 that is between 30 degrees and 90 degrees and preferably between 60 degrees and 90 degrees. The pads are attached to the polishing belt adjacent to each other, as shown in FIG. 2, such that the joint 225 between the pads, forms an angle 235 with the direction of travel of the belt 110 that is unequal to 90 degrees. For the case of a single pad attached to a continuous belt, the two slanted ends of the single pad form a joint, creating a continuous loop.

The slanted pad ends advantageously affect adhesion of the polishing pads to the polishing belt as the pad ends travel over the pulleys which drive the belt. The improvement in adhesion is particularly advantageous for stacked pads such as the IC1400 pad from Rodel, Inc. which have a stiff upper layer.

The polishing pads of the present invention have been described above with reference to CMP apparatus 100 in which a vertically oriented polishing belt travels vertically. It will be appreciated that the polishing pads of the present invention advantageously provide uniform slurry transport and uniformly distribute the non-uniformity in the surface of polishing pads in other belt polishing applications. In particular, the pads provide uniform slurry transport in a polishing apparatus in which the polishing belt is vertically mounted but travels in a horizontal direction. (Consider for example rotating CMP apparatus 100, 90 degrees in the plane of polishing pad 101.) Furthermore, the grooving patterns of the present invention are also used in a belt polishing apparatus in which the belt is mounted horizontally. The polishing pads are attached to a polishing belt which is a continuous loop belt. Alternatively, the polishing belt is an open loop belt including a supply wheel and a take-up wheel. In a further alternative, the polishing pad is molded to the polishing belt so that it takes the same form, open or closed loop.

The detailed description above is provided to illustrate the specific embodiments described herein and is not intended to be limiting. Numerous variations and modifications within the scope of the present invention are possible. For example, while the present invention is illustrated by a CMP apparatus, the present invention is suitable for use with any polishing apparatus. The present invention is defined by the following claims.

We claim:

1. A polishing apparatus, comprising:

a polishing belt, said belt traveling linearly in a first direction; and a polishing pad in association with said polishing belt, said pad having long sides and short sides, said long sides parallel to said first direction, said pad comprising outside portions, said outside portions extending to said long sides and said outside portions having features arranged in a first pattern, and said pad comprising a middle portion having features arranged in a second pattern.

2. A polishing pad as in claim 1 wherein the features in the first pattern are more closely spaced than the features in the second pattern.

3. A polishing pad as in claim 2 wherein the features in the first pattern comprise grooves and the features in the second pattern comprise grooves.

4. A polishing pad as in claim 2 wherein the features in the first pattern comprise perforations and the features in the second pattern comprise perforations.

5. A polishing pad as in claim 1 wherein the features in the first pattern are less closely spaced than the features in the second pattern.

6. A polishing pad as in claim 5 wherein the features in the first pattern comprise grooves and the features in the second pattern comprise grooves.

7. A polishing pad as in claim 5 wherein the features in the first pattern comprise perforations and the features in the second pattern comprise perforations.

8. A polishing pad as in claim 1 wherein the boundaries between the outside portions and the middle portions are slanted with respect to the long sides of the pad.

9. A polishing apparatus as in claim 1 further comprising a carrier head for holding the object against the polishing pad.

* * * * *